United States Patent [19]

Kulyabko et al.

[11] 4,337,008

[45] Jun. 29, 1982

[54] APPARATUS FOR FISH PROTECTION

[76] Inventors: Valery A. Kulyabko, ulitsa 50 let Oktyabrya, 5, kv. 97, Volzhsky; Vera M. Sinyavskaya, prospekt Lenina, 15, kv. 126, Volgograd; Alexandr A. Sivkov, ulitsa Engelsa, 11, kv. 44, Volzhsky; Evgeny N. Gavrilov, ulitsa Dzerzhinskogo, 7, kv. 54, Volgograd, all of U.S.S.R.

[21] Appl. No.: 184,303

[22] Filed: Sep. 5, 1980

[51] Int. Cl.[3] ..... E01F 5/00; E02B 3/00

[52] U.S. Cl. ..... 405/127; 210/460; 405/42; 405/80

[58] Field of Search ..... 405/80–83, 405/36–48, 127; 210/44.5, 446, 460; 137/140

[56] References Cited

U.S. PATENT DOCUMENTS

| | | | |
|---|---|---|---|
| 1,060,616 | 5/1913 | Murray | 137/140 X |
| 1,077,132 | 10/1913 | Erickson | 405/40 |
| 1,109,385 | 9/1914 | Allison | 405/81 X |
| 1,644,121 | 10/1927 | Greene | 210/460 |
| 1,977,464 | 10/1934 | White | 210/460 X |
| 2,311,606 | 2/1943 | Bannister | 210/460 X |
| 2,668,624 | 2/1954 | Wahlin | 210/460 X |
| 2,774,569 | 12/1956 | Jacobsen | 210/460 X |
| 3,826,372 | 7/1974 | Bell | 210/460 X |
| 4,057,968 | 11/1977 | Scott | 405/36 |

FOREIGN PATENT DOCUMENTS

| | | | |
|---|---|---|---|
| 647397 | 2/1979 | U.S.S.R. | 405/81 |

*Primary Examiner*—Dennis L. Taylor

*Attorney, Agent, or Firm*—Robert E. Burns; Emmanuel J. Lobato; Bruce L. Adams

[57] ABSTRACT

A specific feature of the present invention comprising a water-permeable screen mounted on a perforated suction pipe is that located therein between the screen and the pipe are partitions the length of contour of which resting on the screen decreases towards the perforated pipe inlet, the screen surface defined by two adjacent partitions being superior to that of the pipe between the same partitions, whereas the partitions on said pipe are disposed in a manner such that the hydraulic resistances therebetween will increase in proportion to the distance from the partitions to the perforated pipe inlet.

2 Claims, 1 Drawing Figure

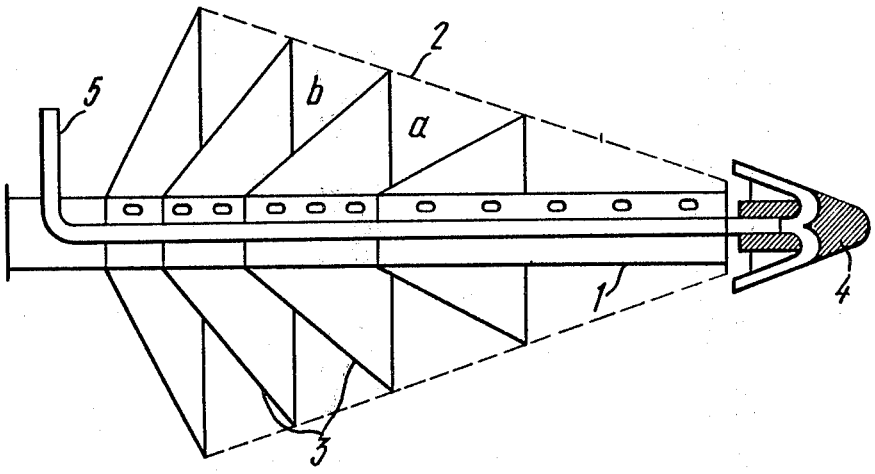
5
b
2
a
1
4
3

APPARATUS FOR FISH PROTECTION

The invention concerns apparatuses intended for environmetal protection, specifically for protection of fish against entrapment in water intakes of different installations, such as, for example, water intakes on hydraulic structures, v-iz., thermal and atomic power stations, irrigation systems; in different-purpose pumping stations, such as those of industrial and domestic use; in fish breeding ponds water supply pumping systems.

The invention may be used to advantage in all branches of industry and agriculture, involving intake of water from piscicultural reservoirs (hydraulic power engineering, hydraulic engineering, land reclamation, water supply, pisciculture).

Widely known in the art are inlet boxes mounted on the suction conduit of mobile pumping stations, containing a cover with a junction unit and a cylindrical box made from a perforated material.

One of the limiting factors of the inlet box consists in that a non-uniform suction velocity field originates on the cylindrical surface thereof during operation of the pumping station, the velocity vectors being directed normally to the surface, i.e. conditions for divering fish are non-existent. At certain sectors of the surface suction velocities are superior to those whereto fish, particularly young fish (or fry) can resist. As the perforations of the box surface become clogged, suction velocities increase. Fish coming into the inlet box attraction zone are drawn to the box surface and perish, whereas fry are sucked into the pumping system and perish therein. The box is quickly clogged, which necessitates frequent interruptions in the operation of the pumping station.

Also known in the art is a fish protection apparatus for pumping stations, comprising a meshy drum, a flushing device located inside the drum and secured on a hollow shaft with an impeller, and a hollow bushing through which water flows into the flushing device.

A limitation of said apparatus consists in that a non-uniform suction velocity field originates on the surface of the meshy drum, the velocity vectors being directed normally to the drum surface with fish-diverting currents non-existent. The flushing device improves the drum operating conditions, for it somewhat prevents the mesh from clogging. However, the action of the flushing device on each sector of the drum being of a periodic character results in the drum getting clogged after some time. A lesser degree of clogging of the meshy drum enhances its fish-protective effect, but the latter is still insignificant. Fish, fry in particular, which find their way into the meshy drum attraction zone, perish in great numbers.

Another disadvantage of the meshy drum consists in that it contains movable underwater units, whose wear impairs operating conditions of the meshy drum, thereby necessitating immobilization thereof. In conditions of uninterruptedwater intake this results in more fish perishing.

Known in the art is another fish-protection apparatus of a water intake arrangement, containing a perforated suction pipe, a corrugated drum secured on the suction pipe and rotating around the axis thereof, the front (in respect of the sense of the drum rotation) walls being made in the form of a protective mesh with the corrugations proper helically directed over the drum surface, a fish-diverting chute forming an annular groove with the drum, and a drum drive.

Said fish-protection apparatus has a deficiency consisting in a high probability of fish, fry in particular, being injured by the rotating corrugated drum, for the wash-off stream formed on the corrugations sharply changes the velocity field of the inward flow. Fish may also be injured by the wash-off stream entering onto the fish-diverting chute in the annular groove.

Another deficiency of said fish-protection apparatus is presence of underwater rotating units complicating the design, operation and repair, thereby considerably reducing its reliability in operation, for failure of the drum drive obviates the conditions for diversion of fish and brings forth additional limitations characteristic of the foregoing apparatuses.

The primary object of the invention is to provide an apparatus for protection of fish against entrapment, e.g., in water intake arrangements, ensuring a higher fish-protective effect, i.e. complete injury-free diversion of fish from the water-suction surface, as compared with prior art fish-protection apparatuses.

Another object of the invention is to enhance protection of the suction surface against contamination with refuse.

A further object of the invention is to improve operating conditions and reliability of the apparatus.

These and other objects are attained in an apparatus for protection of fish against entrapment in, e.g., a water intake arrangement, comprising a water-permeable screen mounted on a perforated suction pipe, according to the invention, wherein located between the screen and the pipe are partitions the length of contour of which resting on the screen decreases towards the perforated pipe inlet, the screen surface defined by two adjacent partitions being superior to that of the pipe between the same partitions, whereas the partitions on said pipe are disposed in a manner such that the hydraulic resistances therebetween will increase in proportion to the distance from the partitions to the perforated pipe inlet.

In the event of apparatus being used for protection of fish in reservoirs with transit currents non-existent, it is advantageous to provide a stream former on the inlet of the perforated pipe, said stream former being intended for washing the water-permeable screen and capable of displacement along the axis of the perforated pipe.

The essence of the proposed invention consists in the following. Arrangement between the water-permeable screen and the perforated suction pipe of partitions, the length of contour of which resting on the screen decreases towards the perforated pipe inlet, determines such a shape of the screen surface that brings about division of the inward flow into a suction stream, with the velocity vectors directed normally to the screen surface, and a wash-off stream, with the velocity vectors directed along the water-permeable screen. The partitions defining a surface of the screen superior to that of the pipe therebetween are disposed on the perforated pipe in a manner such that to build up a hydraulic resistance to the stream sucked through the screen. The hydraulic resistance between the partitions increases in proportion to the distance thereof from the inlet of the perforated pipe.

Different hydraulic pressure between the partitions equalizes suction velocities over the entire surface of the water-permeable screen. In its turn, such uniformity of suction velocities results in a continuous wash-off stream directed along the screen surface. The wash-off stream creates a continuous fish-diverting current around the screen and ensures protection thereof against contamination with refuse.

Owing to the fact that movably mounted on the inlet of the perforated pipe is a stream former to form an additional wash-off stream on the surface of the water-permeable screen, the main wash-off stream on the screen may be reinforced, particularly in conditions when transit currents in the water intake area are non-existent.

Displacement of the stream former along the pipe axis makes it possible to adjust the distance from the additional wash-off stream to the screen surface.

As a result, the fish-protective effect of said apparatus is considerably enhanced to exceed 90% for fish, including fry at least 30 mm long. Besides, the apparatus for fish protection does not require special maintenance due to absence of rotating units and owing to the fact that the wash-off stream reliably clears the water-permeable screen of refuse.

Use of the stream former does not call for considerable water consumption, the latter amounting to a maximum of 3% of the water intake capacity.

The invention will now be explained in greater detail by way of the following description accompanied by a drawing of a specific embodiment of an apparatus for protection of fish against entrapment, e.g., in a water intake arrangement, according to the invention, wherein:

The FIGURE is a longitudinal section of an apparatus for fish protection.

The apparatus for fish protection illustrated in the drawing is intended to be installed on the suction conduit of a pumping station designed for intake of water with the purpose of land irrigation from a lake with transit currents non-existent.

The apparatus for fish protection comprises a perforated suction pipe 1 with a flange for coupling to the suction conduit of the pumping station, a water-permeable screen 2 which may be made from, e.g., a sheet perforated metal with anti-corrosive coating, partitions 3 located between the perforated pipe 1 and the screen 2, made in the form of truncated cones with the smaller bases disposed on the perforated pipe and the larger bases resting on the water-permeable screen, a stream former 4 mounted on the inlet of the perforated pipe 1 with the possibility of displacement along the axis thereof, and a pipeline 5 for supply of the stream former 4.

The perforated suction pipe 1 is intended for uniform water supply of the suction conduit of the pumping station, the clear opening of said pipe being selected so as to enable it to pass several times as much water as the clear opening of the suction conduit. The water-permeable screen 2 is meant for passing water into the apparatus and dividing the inward flow into a suction and a wash-off streams.

The clear opening of the water-permeable screen 2 is selected in such a manner that the velocity of the stream sucked therethrough may be inferior to the velocity of drift for the species of fish being protected on condition of uniform distribution of suction velocity over the surface of the screen 2. The partitions 3 are intended to build up different hydraulic resistances for the stream sucked through the screen 2 and to form a definite shape of the water-permeable screen 2, indispensable for division of the inward flow. The partitions 3 are located between the pipe 1 and the screen 2 in such a manner that the surface of the screen 2 between the adjacent partitions 3 is superior to that of the pipe 1, whereas hydraulic resistance between the partitions increases in proportion to the distance from the partitions 3 to the inlet of the perforated pipe 1, e.g. hydraulic resistance of the volume "b" is superior to that of the volume "a".

The stream former is designed to reinforce the wash-off stream on the screen 2; it represents a conical figure with an inner cavity associated with the supply pipeline 5, and a number of nozzles disposed on the cone generatrices, directed towards the base of the cone and associated with the inner cavity thereof. The stream former 4 is installed with its base facing the inlet of the pipe 1. The pipeline 5 for supply of the stream former 4 is intended to supply the stream-forming reagent into the stream former.

The proposed apparatus for protection of fish against entrapment, e.g., in a water intake arrangement operates as follows. With the water intake source operating, the inward flow rushes onto the surface of the swater-permeable screen 2 to be divided into a suction and wash-off streams. The partitions 3 give rise to conditions for uniform suction on the entire surface of the screen 2 with minimal velocities for the fish to resist in order to avoid being pressed to the surface of the screen 2. The wash-off stream acting along the surface of the screen 2 diverts the fish from the apparatus. The wash-off effect is enhanced by the action of jets of the stream former 4, which form a solid hydraulic flow around the apparatus due to the use of the surrounding water. The wash-off stream also carries away floating refuse from the surface of the apparatus.

The present apparatus for fish protection may be used to advantage for intake of water both from rivers and reservoirs. It is capable of guarding fish against injury and of keeping fry off water intake arrangements.

What is claimed is:

1. An apparatus for protection of fish against entrapment, e.g., in a water intake arrangement, including: a perforated suction pipe; a water-permeable screen mounted on said pipe; partitions located between said pipe and screen, the length of contour of which resting on the screen decreases towards the perforated pipe inlet, the screen surface defined by two adjacent partitions being superior to that of the pipe between the same partitions; said partitions disposed on said pipe in a manner such that the hydraulic resistances therebetween will increase in proportion to the distance from the partitions to the perforated pipe inlet.

2. An apparatus as claimed in claim 1, wherein provided on the inlet of the perforated pipe is a stream former capable of displacement along the axis thereof and intended for washing the water-permeable screen.

* * * * *